US011629732B1

(12) United States Patent
Zhu

(10) Patent No.: US 11,629,732 B1
(45) Date of Patent: Apr. 18, 2023

(54) FAN WITH EASY-TO-ASSEMBLE CLAMPING DEVICE

(71) Applicant: Guangdong Aoyun Technology Co., Ltd., Guangdong (CN)

(72) Inventor: Xueping Zhu, Guangdong (CN)

( * ) Notice: Subject to any disclaimer, the term of this patent is extended or adjusted under 35 U.S.C. 154(b) by 0 days.

(21) Appl. No.: 17/967,690

(22) Filed: Oct. 17, 2022

(30) Foreign Application Priority Data

Aug. 8, 2022 (CN) ..... 2022220770517

(51) Int. Cl.
*F04D 29/64* (2006.01)
*F04D 29/60* (2006.01)

(52) U.S. Cl.
CPC ..... *F04D 29/646* (2013.01); *F04D 29/601* (2013.01)

(58) Field of Classification Search
CPC .. F04D 29/646; F04D 29/601; F04D 29/4253; F04D 29/522; F04D 29/64; F04D 29/52; F04D 25/105
USPC ..... 248/689, 185.1, 188.1; 417/246, 247 R; 415/212.1; 416/246
See application file for complete search history.

(56) References Cited

U.S. PATENT DOCUMENTS 4,799,859 A * 1/1989 Zimmer ..... B64C 27/325 416/20 R
4,850,804 A * 7/1989 Huang ..... F16M 13/022 416/246
5,547,343 A * 8/1996 Jane ..... F04D 29/601 416/246
5,725,356 A * 3/1998 Carter ..... F16M 11/40 D23/382
6,886,270 B2 * 5/2005 Gilmer ..... F04D 29/601 34/239
10,724,529 B2 * 7/2020 Lin ..... F04D 29/646
11,350,748 B2 * 6/2022 Ediger ..... F16M 11/126
D962,417 S * 8/2022 Ye ..... D23/382
11,536,294 B1 * 12/2022 Zhu ..... F04D 29/646

* cited by examiner

*Primary Examiner* — Todd M Epps

(57) ABSTRACT

A fan with an easy-to-assemble clamping device includes a fan main body, a supporting framework, and a clamping device. The clamping device includes a first clamp body rotatably connected to the supporting framework; a second clamp body rotatably connected to the first clamp body, a torsional spring and a main body. One side of the second clamp body facing to the first clamp body is provided with a limiting slot. The torsional spring is plugged between the first clamp body and the second clamp body. A first free end of the torsional spring is abutted against a pressing end of the first clamp body, and a second free end of the torsional spring is abutted against a pressing end of the second clamp body. The main body of the torsional spring is abutted against a side wall of the limiting slot.

14 Claims, 12 Drawing Sheets

FAN WITH EASY-TO-ASSEMBLE CLAMPING DEVICE

CROSS-REFERENCE TO RELATED APPLICATIONS

The application claims priority of Chinese patent applications 202222077051. 7 and 202222077361. 9, both filed on Aug. 8, 2022, which are incorporated herein by reference in their entireties.

TECHNICAL FIELD

The present disclosure relates to the technical field of household appliances, in particular to a fan with an easy-to-assemble clamping device.

BACKGROUND

Fans are the most commonly used cooling tools. According to different application occasions, their shapes and sizes are different. However, the basic principle is to use a motor to drive an impeller to rotate, thus driving air to flow to form a forced air flow. There are many kinds of fans on the market according to use manners and scenarios, such as a ceiling fan, a handheld fan, a fixed fan, a clamped fan. The clamped fan can be moved away or fixedly clamped, is applicable to various scenarios, and is especially popular.

At present, clamped fan products on the market generally have certain problems. A clamping device of the clamped fan usually needs to fix a torsional spring, an upper clamp body, and a lower clamp body by using a screw to cooperate with a rotating shaft. The assembling is troublesome, and the production efficiency is low. Furthermore, an exposed screw head or nut also affects the appearance of a product, and the use experience of a user is poor.

SUMMARY

In order to overcome the shortcomings in the prior art, the present disclosure provides a fan with an easy-to-assemble clamping device, which is simple in structure and has a good sealing effect.

The present disclosure adopts the following technical solution: a fan with an easy-to-assemble clamping device, including a fan main body, a supporting framework, and a clamping device; the fan main body is rotatably connected to the supporting framework; the supporting framework is rotatably connected to the clamping device; the clamping device includes: a first clamp body, wherein the first clamp body is rotatably connected to the supporting framework; a second clamp body, wherein the second clamp body is rotatably connected to the first clamp body, and one side of the second clamp body facing to the first clamp body is provided with a limiting slot; a torsional spring, wherein the torsional spring is plugged between the first clamp body and the second clamp body; a first free end of the torsional spring is abutted against a pressing end of the first clamp body; a second free end of the torsional spring is abutted against a pressing end of the second clamp body; and a main body of the torsional spring is abutted against a side wall of the limiting slot.

Further, the first clamp body is provided with a plugging part; the plugging part is provided with a rotating shaft; the second clamp body is provided with a plugging slot; a rotating shaft hole is arranged in the plugging slot; and the plugging part is plugged along the plugging slot, so that the rotating shaft is rotatably plugged to the rotating shaft hole.

Further, the rotating shaft is provided with a first guide slope; a side wall of the plugging slot is provided with a second guide slope; and when the plugging part is plugged along the plugging slot, the first guide slope slides along the second guide slope, so that the rotating shaft is rotatably plugged in the rotating shaft hole.

Further, one side of the first clamp body facing to the second clamp body is provided with a first accommodating slot; one side of the second clamp body facing to the first clamp body is provided with a second accommodating slot; the first free end of the torsional spring is clamped to the first accommodating slot; and the second free end of the torsional spring is clamped to the second accommodating slot.

Further, a fitting arc surface is arranged inside the limiting slot; and an outer surface of a spiral part of the torsional spring is clung to the fitting arc surface.

Further, one side of a clamping end of the first clamp body facing to the second clamp body is provided with a first buffer pad; one side of a clamping end of the second clamp body facing to the first clamp body is provided with a second buffer pad; and the first buffer pad is abutted against the second buffer pad.

Further, one side of the second clamp body facing away from the first clamp body is provided with several friction pads.

Further, the fan main body is provided with a first plugging hole; one end of the supporting framework is provided with a first plugging shaft; a first limiting block is convexly arranged on a surface of a tail end of the first plugging shaft; the first plugging shaft is plugged to the first plugging hole; and the first limiting block is clamped to an edge of the first plugging hole.

Further, the clamping device is provided with a second plugging hole; the other end of the supporting framework is provided with a second plugging shaft; a second limiting block is convexly arranged on a surface of a tail end of the second plugging shaft; the second plugging shaft is plugged to the second plugging hole; and the second limiting block is clamped to an edge of the second plugging hole.

Further, the first plugging shaft is provided with a first movable open slot extending along an axial direction of the first plugging shaft; and the first movable open slot is used for allowing the first plugging shaft to deform.

Further, the second plugging shaft is provided with a second movable open slot extending along an axial direction of the second plugging shaft; and the second movable open slot is used for allowing the second plugging shaft to deform.

Further, a side wall of the first plugging hole is provided with a first guide slot; an edge of the first limiting block is provided with a first guide surface; and the first guide surface slides along the first guide slot when the first plugging shaft is plugged along the first plugging hole.

Further, a side wall of the second plugging hole is provided with a second guide slot; an edge of the second limiting block is provided with a second guide surface; and the second guide surface slides along the second guide slot when the second plugging shaft is plugged along the second plugging hole.

Further, the supporting framework is U-shaped; the first plugging shaft is arranged at two free ends of the U-shaped supporting framework; and the second plugging shaft is arranged in the middle of the U-shaped supporting framework.

The present disclosure has the beneficial effects: by the above-mentioned structural arrangement, during use, the first clamp body and the second clamp body are assembled, and an elastomer is then plugged between the first clamp body and the second clamp body; at this time, the limiting slot is abutted against front and rear surfaces of the main body of the torsional spring to effectively limit the position of the torsional spring and improve the stability of a product; the first free end of the torsional spring is abutted against the pressing end of the first clamp body, and the second free end of the torsional spring is abutted against the pressing end of the second clamp body, so that the elastomer can effectively provide an elastic force, and the clamping device can be stably clamped at a clamping position.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
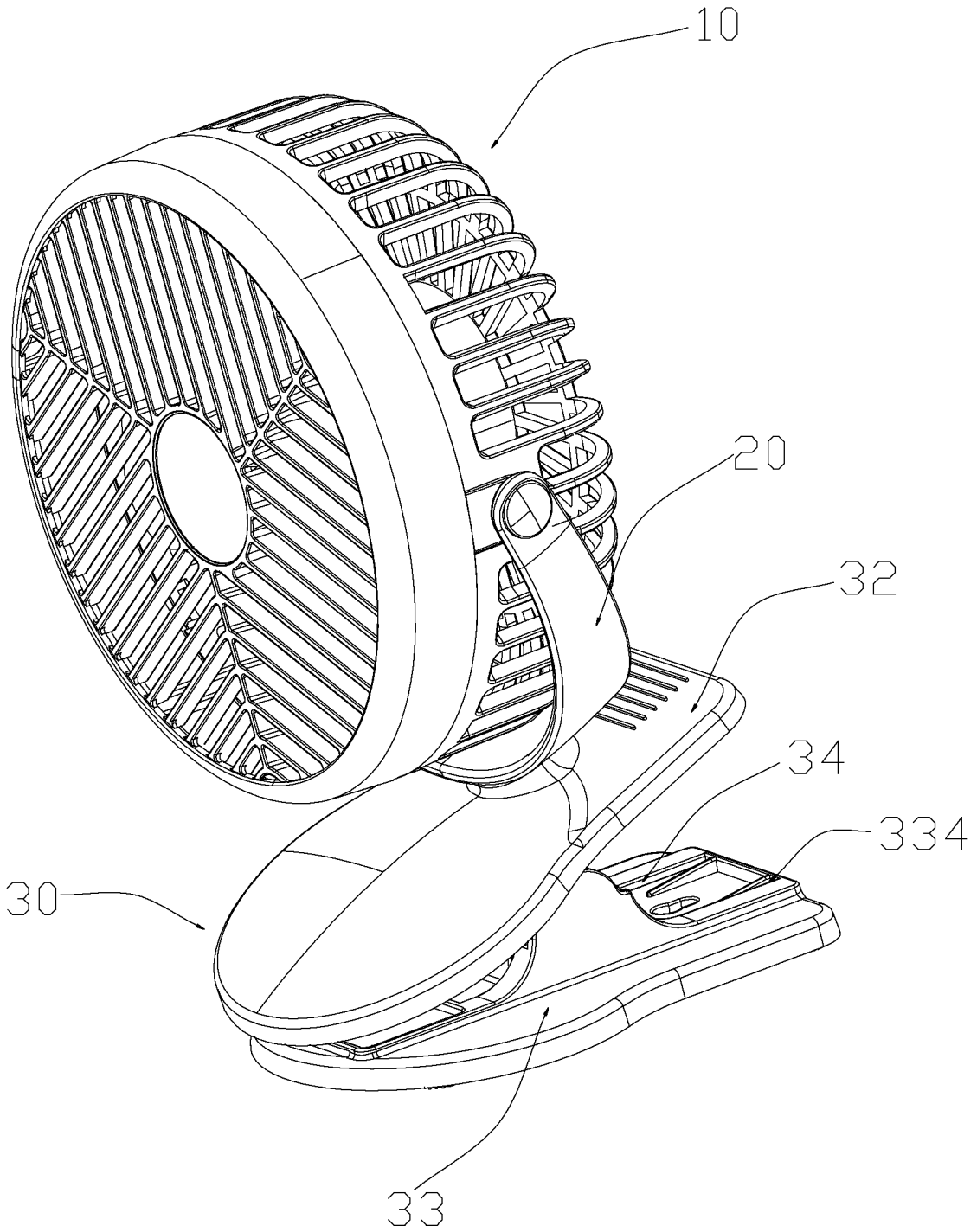
FIG. 1 is a schematic diagram of an overall structure from one angle of a fan of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the application, "a plurality of" means two or more, unless otherwise specifically defined.

Figure 2:
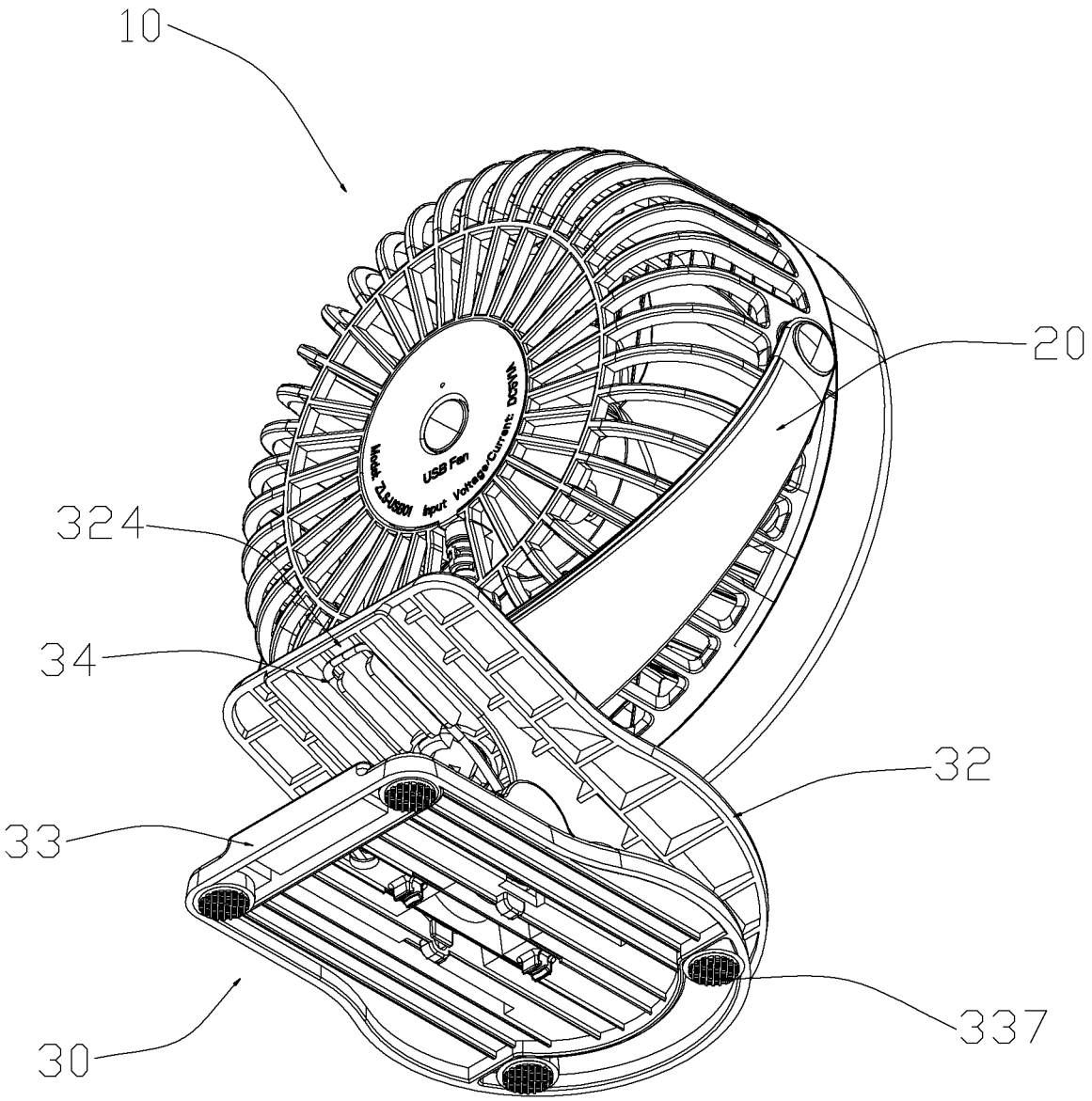
FIG. 2 is a schematic diagram of an overall structure from another angle of a fan of the present disclosure.
Figure 3:
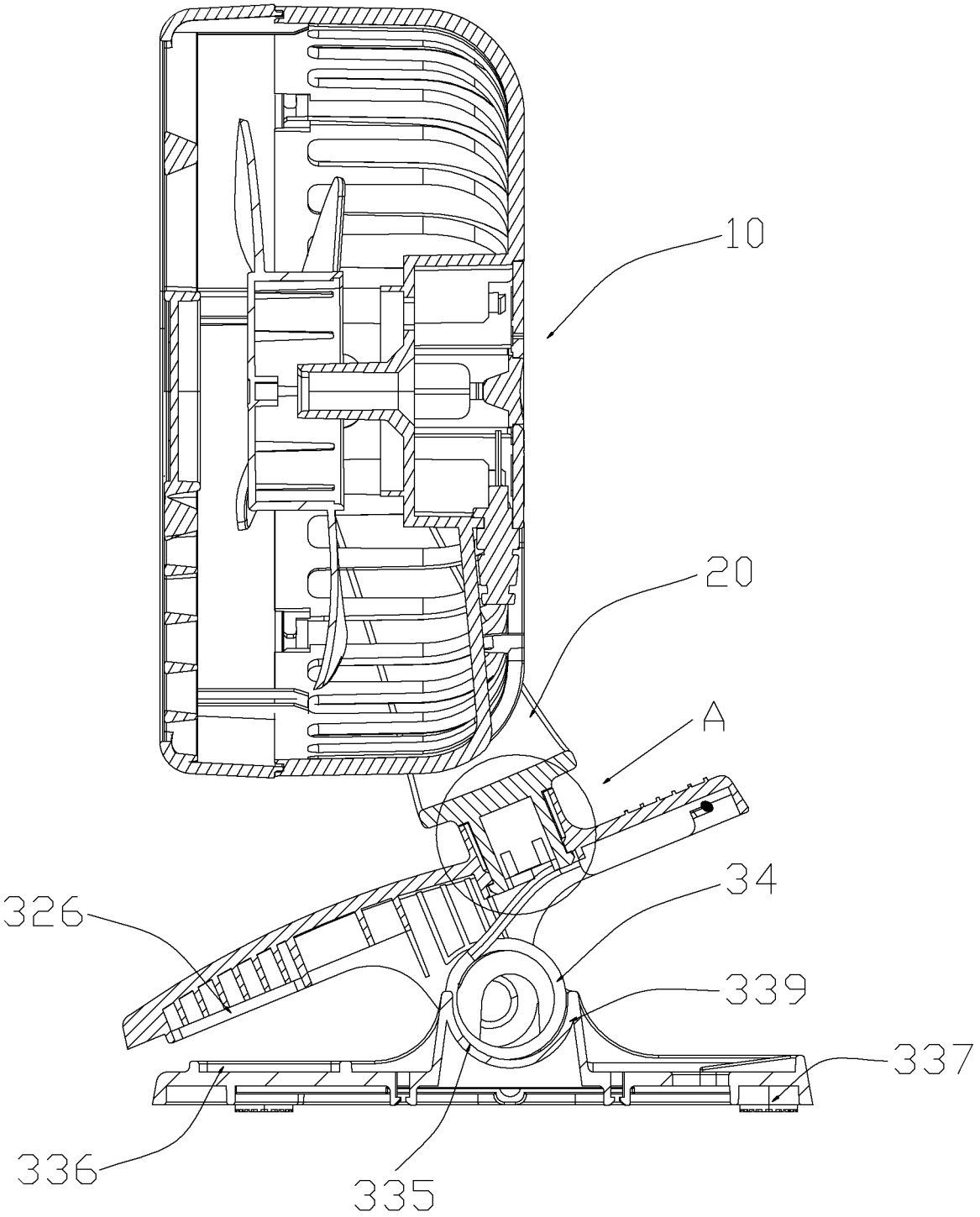
FIG. 3 is a schematic diagram of a sectional structure from one angle of a fan of the present disclosure.
Figure 4:
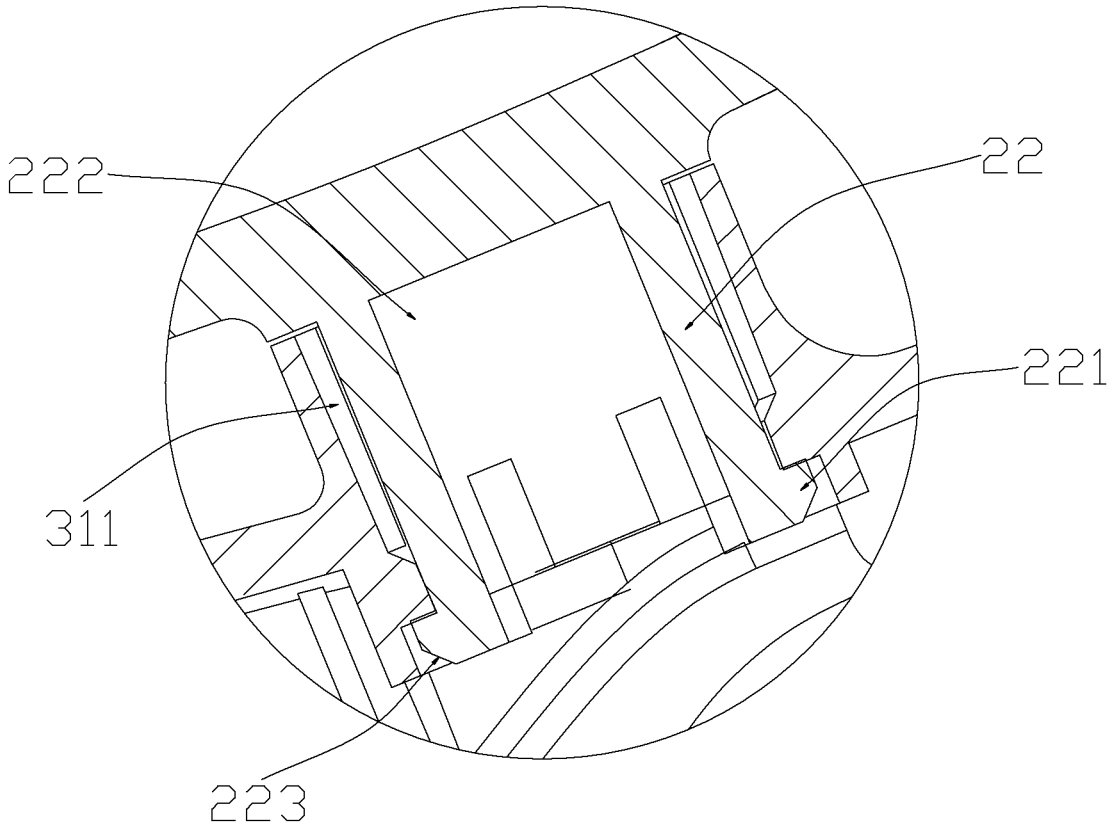
FIG. 4 is an enlarged diagram of circle A in FIG. 3.
Figure 5:
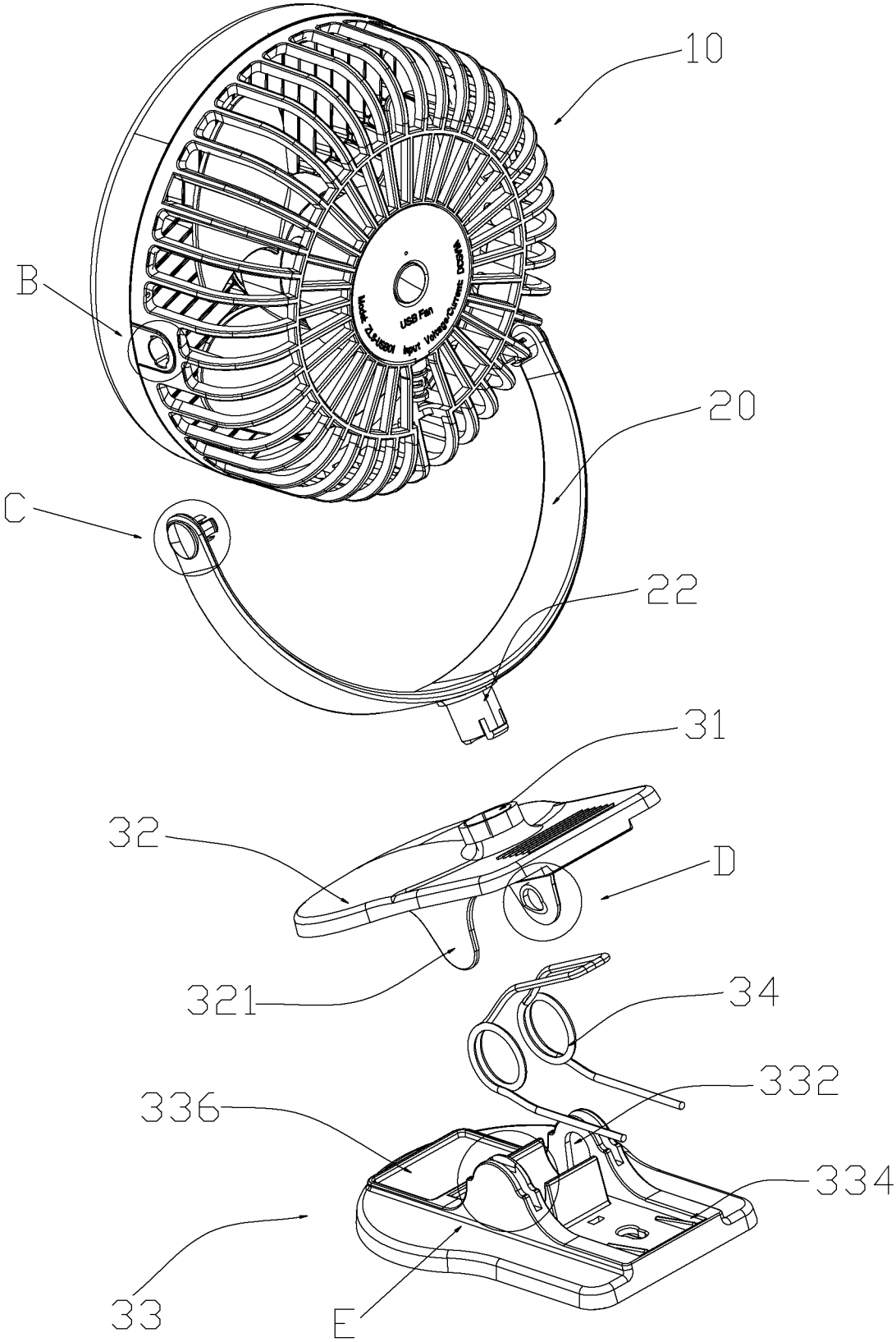
FIG. 5 is a schematic exploded structural diagram from one angle of an ink box of the present disclosure.
Figure 6:
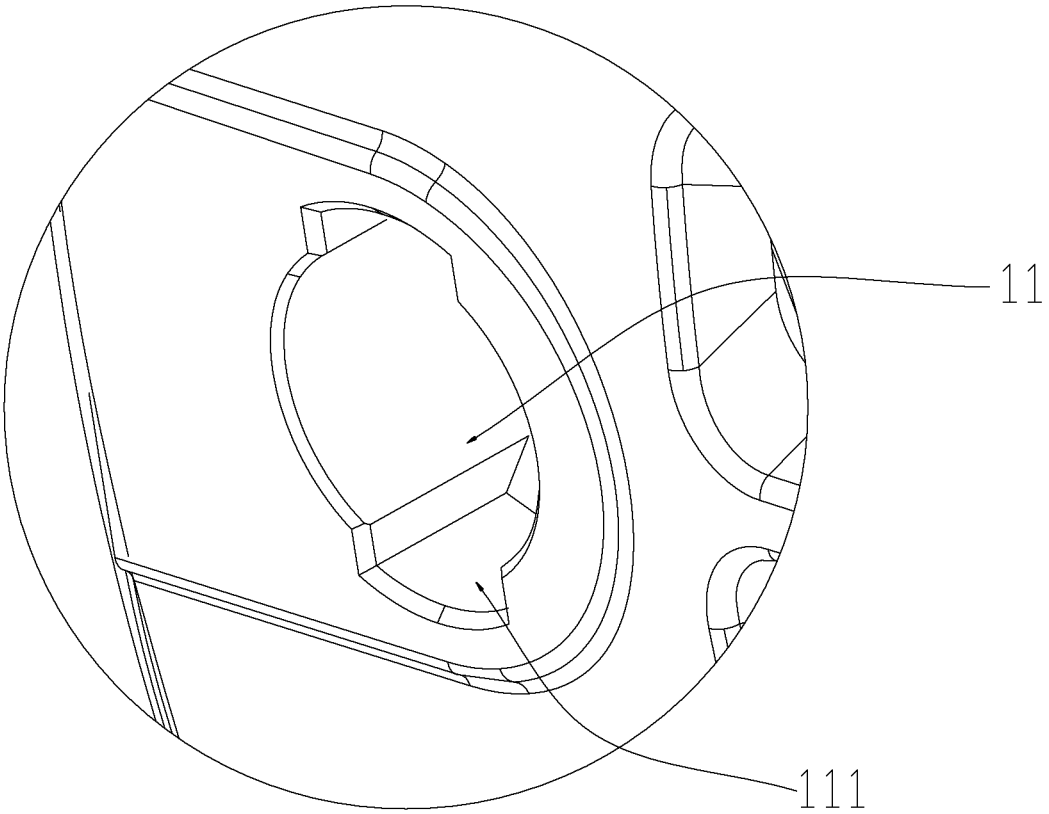
FIG. 6 is an enlarged diagram of circle B in FIG. 5.
Figure 7:
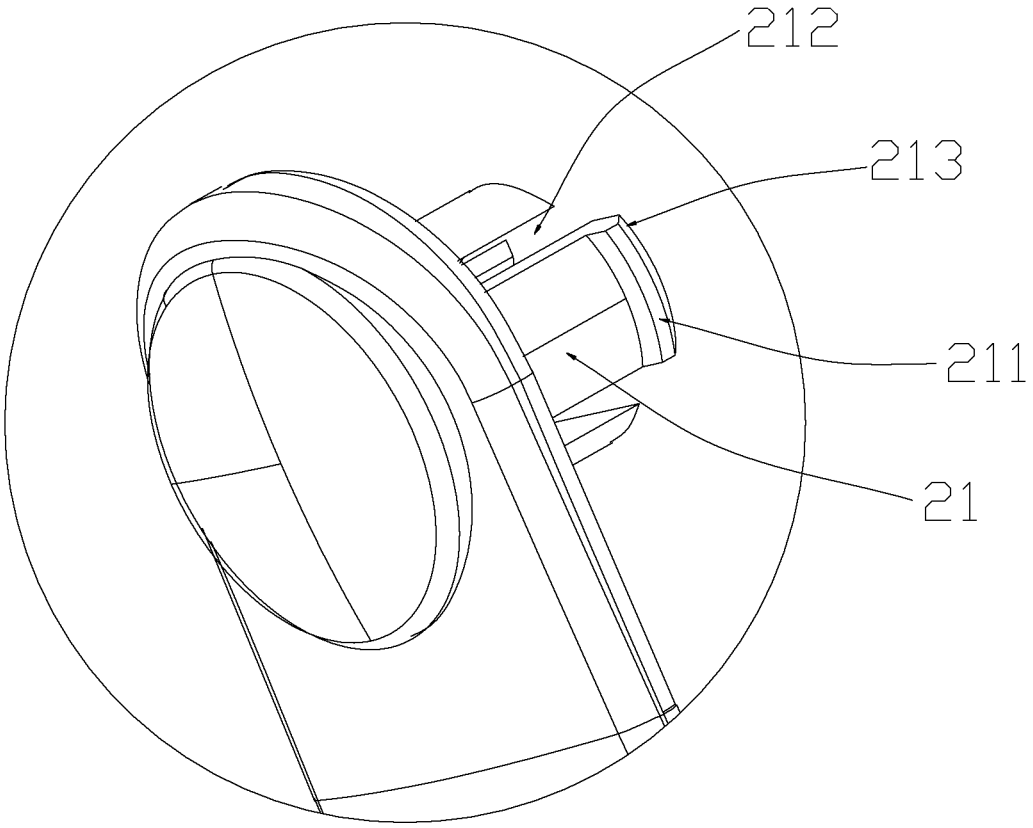
FIG. 7 is an enlarged diagram of circle C in FIG. 5.
Figure 8:
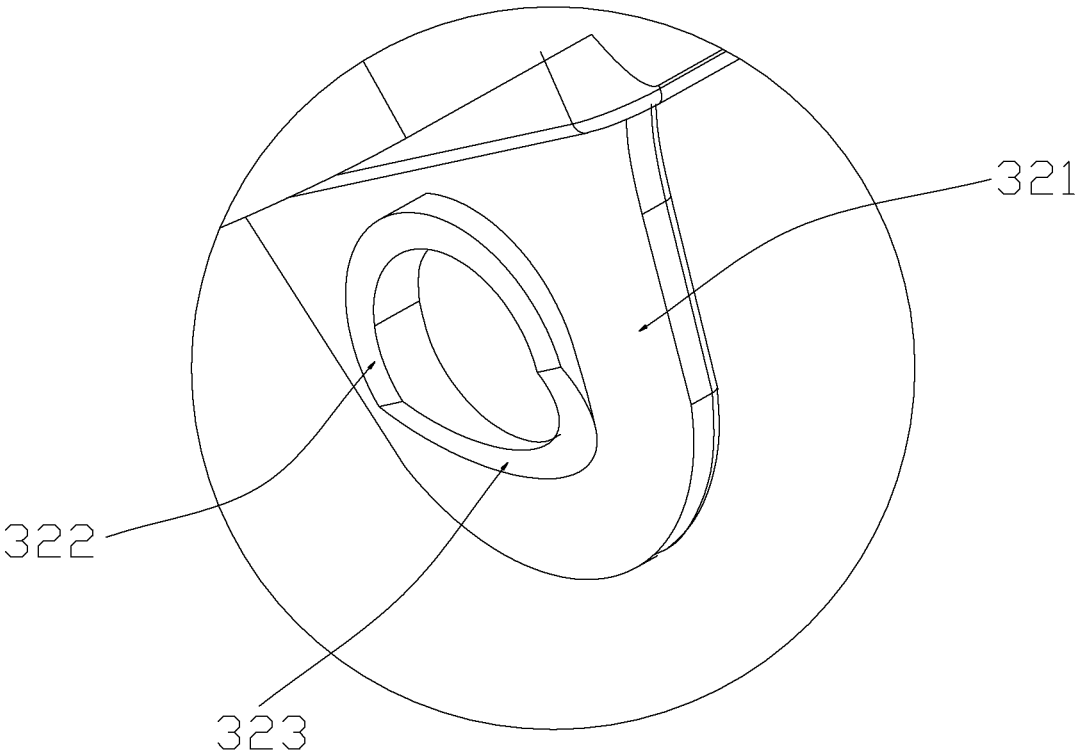
FIG. 8 is an enlarged diagram of circle D in FIG. 5.
Figure 9:
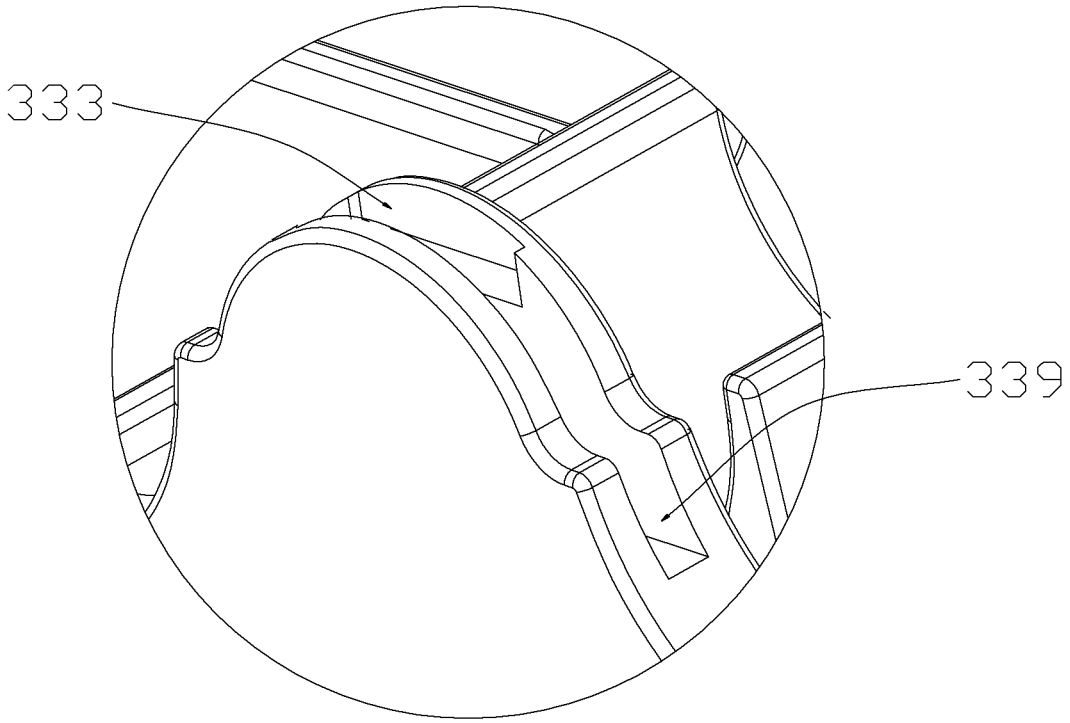
FIG. 9 is an enlarged diagram of circle E in FIG. 5.
Figure 10:
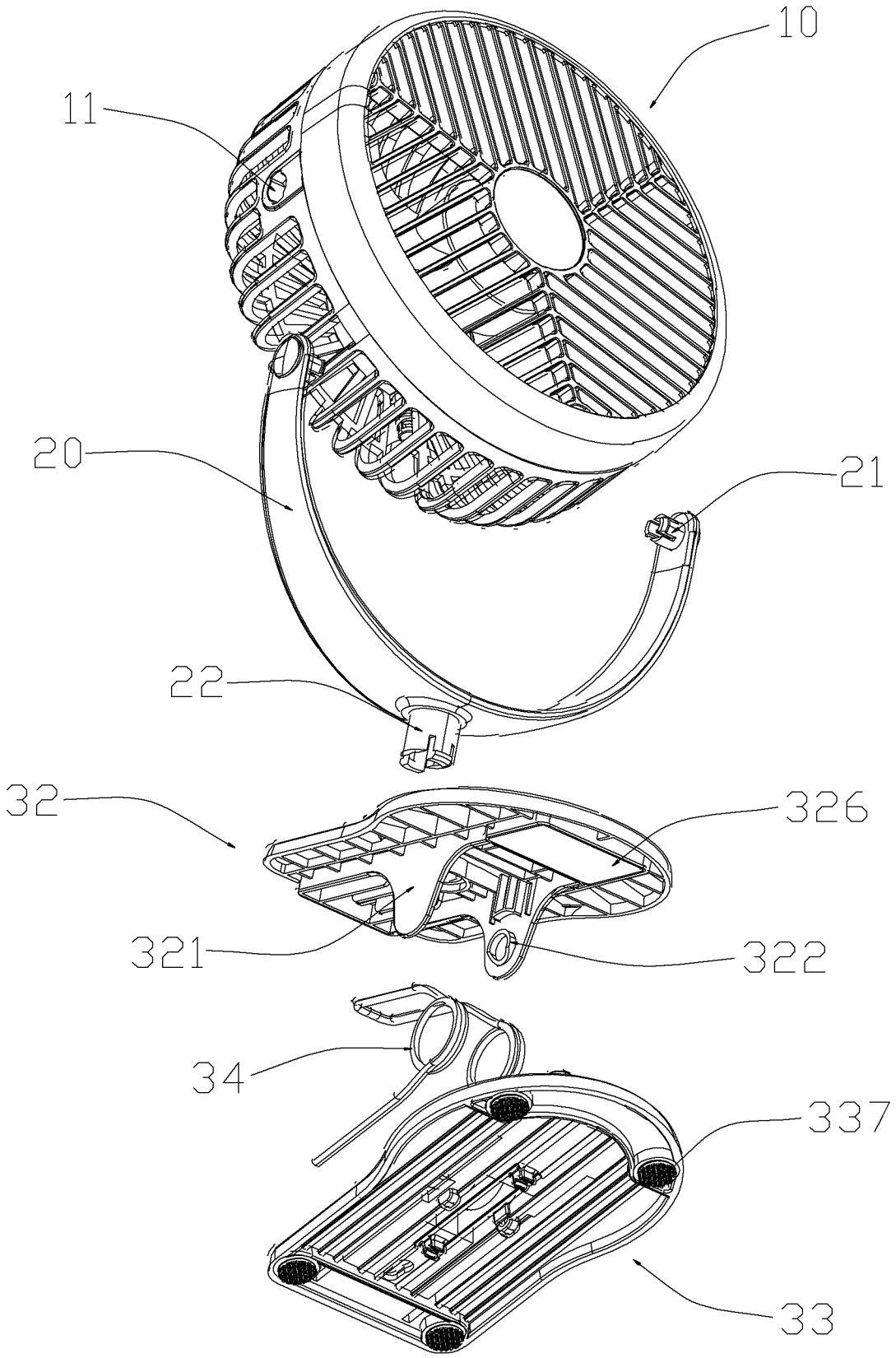
FIG. 10 is a schematic exploded structural diagram from another angle of a fan of the present disclosure.
Figure 11:
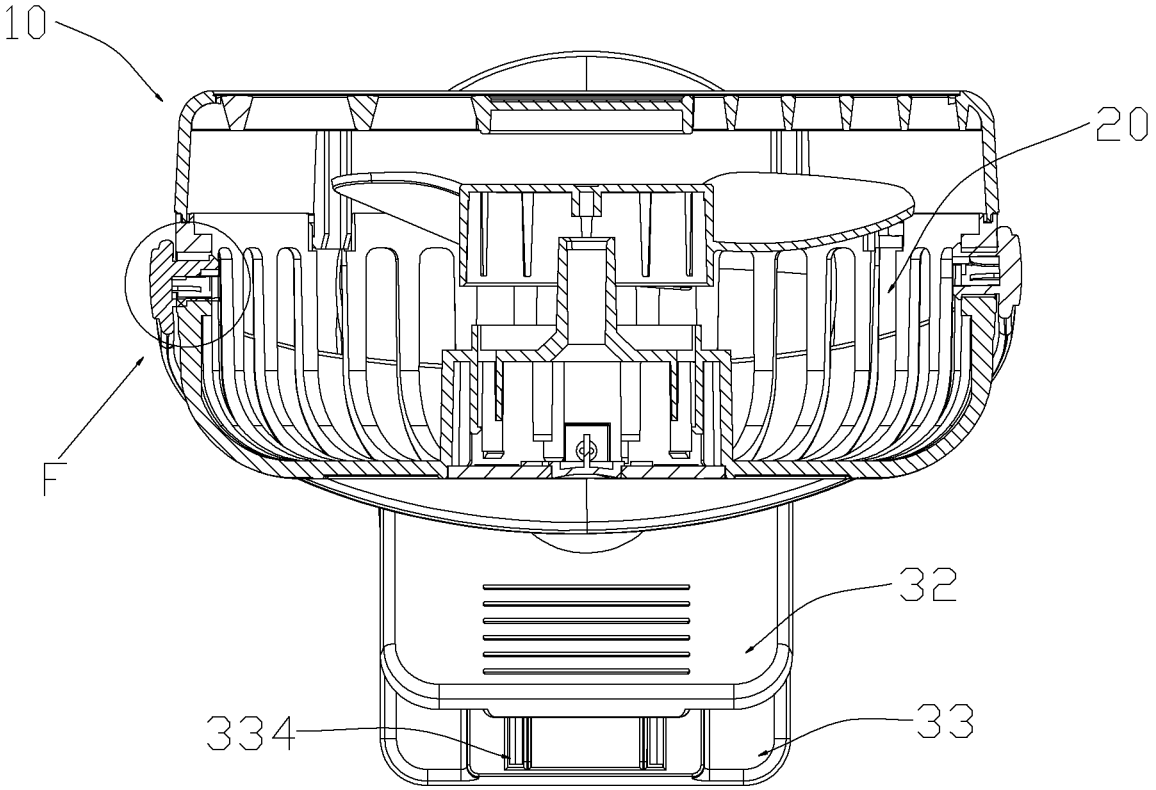
FIG. 11 is a schematic diagram of a sectional structure from another angle of a fan of the present disclosure.
Figure 12:
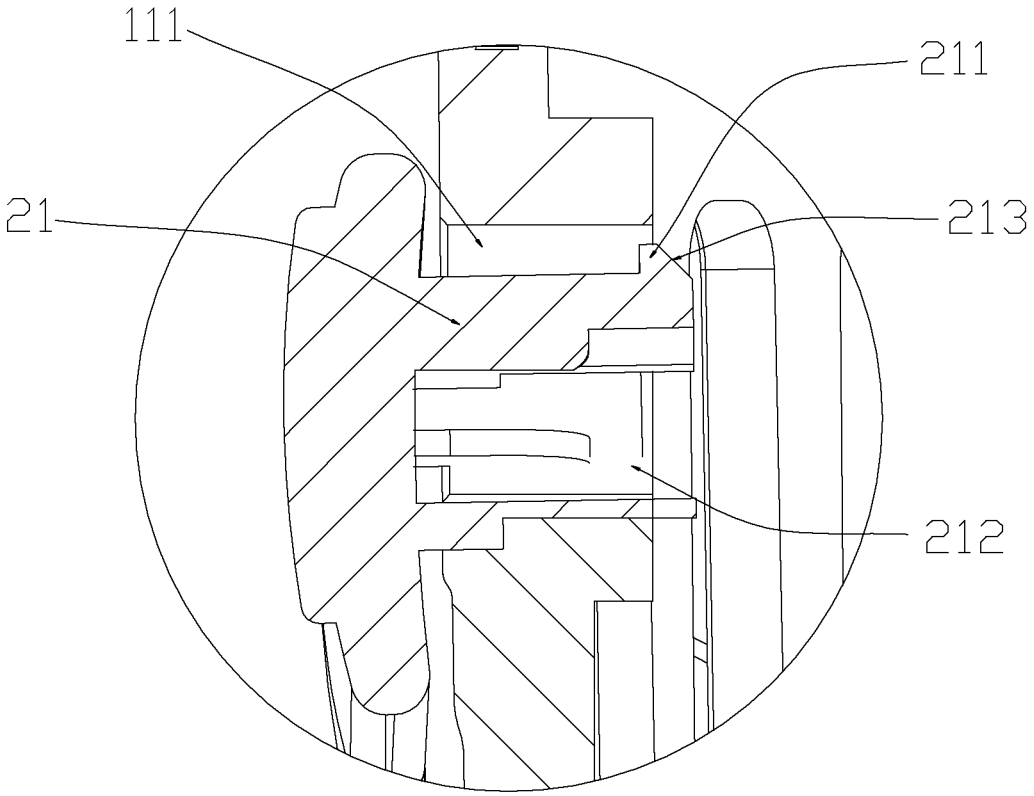
FIG. 12 is an enlarged diagram of circle F in FIG. 11.

Referring to FIG. 1 to FIG. 12, the fan with the easy-to-assemble clamping device 30 includes a fan main body 10, a supporting framework 20, and a clamping device 30. The fan main body 10 is rotatably connected to the supporting framework 20, and the supporting framework 20 is rotatably connected to the clamping device 30. The clamping device 30 includes:

a first clamp body 32, wherein the first clamp body 32 is rotatably connected to the supporting framework 20;

a second clamp body 33, wherein the second clamp body 33 is rotatably connected to the first clamp body 32, and one side of the second clamp body 33 facing to the first clamp body 32 is provided with a limiting slot 339; and a torsional spring 34, wherein the torsional spring 34 is plugged between the first clamp body 32 and the second clamp body 33; a first free end of the torsional spring 34 is abutted against a pressing end of the first clamp body 32; a second free end of the torsional spring 34 is abutted against a pressing end of the second clamp body 33; and a main body of the torsional spring 34 is abutted against a side wall of the limiting slot 339.

By the above-mentioned structural arrangement, during use, the first clamp body 32 and the second clamp body 33 are assembled, and an elastomer is then plugged between the first clamp body 32 and the second clamp body 33; at this time, the limiting slot 339 is abutted against front and rear surfaces of the main body of the torsional spring 34 to effectively limit the position of the torsional spring 34 and improve the stability of a product; the first free end of the torsional spring 34 is abutted against the pressing end of the first clamp body 32, and the second free end of the torsional spring 34 is abutted against the pressing end of the second clamp body 33, so that the elastomer can effectively provide an elastic force, and the clamping device 30 can be stably clamped at a clamping position.

The first clamp body 32 is provided with a plugging part 321; the plugging part 321 is provided with a rotating shaft 322; the second clamp body 33 is provided with a plugging slot 331; a rotating shaft hole 332 is arranged in the plugging slot 331; and the plugging part 321 is plugged along the plugging slot 331, so that the rotating shaft 332 is rotatably plugged to the rotating shaft hole 332. By the above structural arrangement, during use, the plugging part 321 is plugged along the plugging slot 331; at this time, the rotating shaft 322 is abutted against an inner wall of the plugging slot 331; and the inner wall of the plugging slot 331 and the rotating shaft 322 deform slightly such that the plugging part 321 is successfully plugged along the plugging slot 331. When the plugging part 321 is plugged to an assembling position, the rotating shaft 322 is plugged to the rotating shaft hole 332 to achieve rotatable connection between the first clamp body 32 and the second clamp body 33. Meanwhile, the assembling is facilitated; the step of assembling with a screw is eliminated; the assembling efficiency is effectively improved; the production rate is increased; the cost is reduced; use of screws is also reduced; and the overall structure of the product is more beautiful.

The rotating shaft 322 is provided with a first guide slope 323; a side wall of the plugging slot 331 is provided with a second guide slope 333; and when the plugging part 321 is plugged along the plugging slot 331, the first guide slope 323 slides along the second guide slope 333, so that the rotating shaft 322 is rotatably plugged in the rotating shaft hole 332. By the above structural arrangement, when the plugging part 321 is plugged along the plugging slot 331, the inclined first guide slope 323 is abutted against the inclined second guide slope 333, so that the plugging part 321 can be successfully plugged along the plugging slot 331, which facilitates the assembling by a user, improves the assembling efficiency of a product, and guarantees the finished product ratio of the product.

One side of the first clamp body 32 facing to the second clamp body 33 is provided with a first accommodating slot 324; one side of the second clamp body 33 facing to the first clamp body 32 is provided with a second accommodating slot 334; the first free end of the torsional spring 34 is clamped to the first accommodating slot 324; and the second free end of the torsional spring 34 is clamped to the second accommodating slot 334. By the above structural arrangement, the first accommodating slot 324 can effectively limit the first free end of the torsional spring 34 to prevent the first free end from falling off and improve the stability of the product, so that an elastic force of the torsional spring 34 can be transmitted to the first clamp body 32 more effectively. The second accommodating slot 334 can effectively limit the second free end of the torsional spring 34 to prevent the second free end from falling off and improve the stability of the product, so that the elastic force of the torsional spring 34 can be transmitted to the second clamp body 33 more effectively. It is also convenient for the user to position the torsional spring 34 during assembling of the product; assembling by the user is facilitated; and the production efficiency is improved.

A fitting arc surface 335 is arranged inside the limiting slot 339; and an outer surface of a spiral part of the torsional spring 34 is clung to the fitting arc surface 335. By the above structural arrangement, the torsional spring 34 is cheap and convenient to assemble, and can effectively adapt to the clamping device 30. Meanwhile, the outer surface of the spiral part of the torsional spring 34 is clung to the fitting arc surface 335, which can also prevent the torsional spring 34 from being skewed, so that the stability of the product is effectively improved.

One side of a clamping end of the first clamp body 32 facing to the second clamp body 33 is provided with a first buffer pad 326; one side of a clamping end of the second clamp body 33 facing to the first clamp body 32 is provided with a second buffer pad 336; and the first buffer pad 326 is abutted against the second buffer pad 336. By the above structural arrangement, the first buffer pad 326 and the second buffer pad 336 can make the clamping end of the first clamp body 32 and the clamping end of the second clamp body 33 softer when the clamping ends are in contact with a contact surface, so that the user will not damage the clamping position when clamping and fixing the product, and the use experience of the user is enhanced. Meanwhile, a friction force between the first clamp body 32, as well as the second clamp body 33, and the clamping position can also increased; and the stability of the product is improved.

One side of the second clamp body 33 facing away from the first clamp body 32 is provided with several friction pads 337. By the above structural arrangement, due to the arrangement of the friction pads 337, the friction force can increase when the user places the clamping device 30 on a placement plane, so that the stability of the product is further improved.

The fan main body 10 is provided with a first plugging hole 11; one end of the supporting framework 20 is provided with a first plugging shaft 21; a first limiting block 211 is convexly arranged on a surface of a tail end of the first plugging shaft 21; the first plugging shaft 21 is plugged to the first plugging hole 11; and the first limiting block 211 is clamped to an edge of the first plugging hole 11. By the above structural arrangement, during use, the first plugging shaft 21 is plugged along the first plugging hole 11, so that the first plugging shaft 21 and the first limiting block 211 deform slightly. When the first plugging shaft 21 is plugged to the assembling position, the first limiting block 211 is reset and is clamped to the edge of the first plugging hole 11, which can effectively limit an axial movement of the first plugging shaft 21, so that the first plugging shaft 21 is rotatably arranged in the first plugging hole 11; and it is convenient for the user to adjust an angle between the fan main body 10 and the supporting framework 20 and to adjust an orientation of the fan up and down. The assembling is facilitated; the step of assembling with a screw is eliminated; the assembling efficiency is effectively improved; the production rate is increased; the cost is reduced; use of screws is also reduced; and the overall structure of the product is more beautiful.

The clamping device 30 is provided with a second plugging hole 31; the other end of the supporting framework 20 is provided with a second plugging shaft 22; a second limiting block 221 is convexly arranged on a surface of a tail end of the second plugging shaft 22; the second plugging shaft 22 is plugged to the second plugging hole 31; and the second limiting block 221 is clamped to an edge of the second plugging hole 31. By the above structural arrangement, during use, the second plugging shaft 22 is plugged along the second plugging hole 31, so that the second plugging shaft 22 and the second limiting block 221 deform slightly. When the second plugging shaft 22 is plugged to the assembling position, the second limiting block 221 is reset and is clamped to the edge of the second plugging hole 31, which can effectively limit an axial movement of the second plugging shaft 22, so that the second plugging shaft 22 is rotatably arranged in the second plugging hole 31; and it is convenient for the user to adjust an angle between the supporting framework 20 and the clamping device 30 and to adjust an orientation of the fan left and right. The assembling is facilitated; the step of assembling with a screw is eliminated; the assembling efficiency is effectively improved; the production rate is increased; the cost is reduced; use of screws is also reduced; and the overall structure of the product is more beautiful.

The first plugging shaft 21 is provided with a first movable open slot 212 extending along an axial direction of the first plugging shaft 21; and the first movable open slot 212 is used for allowing the first plugging shaft 21 to deform. By the above structural arrangement, the first movable open slot 212 is formed in the first plugging shaft 21, which realizes that the first plugging shaft 21 has a deformation hole part. When the first plugging shaft 21 is plugged along the first plugging hole 11, the first plugging shaft 21 deforms more easily, which greatly lowers the assembling difficulty, increases the assembling speed of the product, and improves the production efficiency. Meanwhile, damage to the product caused by overexerting during assembling can also be prevented, and the finished product ratio of the product is increased.

The second plugging shaft 22 is provided with a second movable open slot 222 extending along an axial direction of the second plugging shaft 22; and the second movable open slot 222 is used for allowing the second plugging shaft 22 to deform. By the above structural arrangement, the second movable open slot 222 is formed in the second plugging shaft 22, which realizes that the second plugging shaft 22 has a deformation hole part. When the second plugging shaft 22 is plugged along the second plugging hole 31, the second plugging shaft 22 deforms more easily, which greatly lowers the assembling difficulty, increases the assembling speed of the product, and improves the production efficiency. Meanwhile, damage to the product caused by overexerting during assembling can also be prevented, and the finished product ratio of the product is increased.

A side wall of the first plugging hole 11 is provided with a first guide slot 111; an edge of the first limiting block 211 is provided with a first guide surface 213; and the first guide surface 213 slides along the first guide slot 111 when the first plugging shaft 21 is plugged along the first plugging hole 11. By the above structural arrangement, the edge of the first limiting block 211 is provided with the inclined first guide surface 213, which can further facilitate the user to assemble the product; and by the cooperation with the first guide slot 111, the user can assemble the fan main body 10 and the supporting framework 20 more easily, and the production rate of the product is increased.

A side wall of the second plugging hole 31 is provided with a second guide slot 311; an edge of the second limiting block 221 is provided with a second guide surface 223; and the second guide surface 223 slides along the second guide slot 311 when the second plugging shaft 22 is plugged along the second plugging hole 31. By the above structural arrangement, the edge of the second limiting block 221 is provided with the inclined second guide surface 223, which can further facilitate the user to assemble the product; and by the cooperation with the second guide slot 311, the user can assemble the supporting framework 20 and the clamping device 30 more easily, and the production rate of the product is increased.

The supporting framework 20 is U-shaped; the first plugging shaft 21 is arranged at two free ends of the U-shaped supporting framework 20; and the second plugging shaft 22 is arranged in the middle of the U-shaped supporting framework 20. By the above structural arrangement, the supporting framework 20 is U-shaped, and the first plugging shaft 21 located at the two ends of the U-shaped supporting framework is symmetric, so that the fan main body 10 and the supporting framework 20 are assembled more stably. Meanwhile, an arc part of the U-shaped supporting framework can also allow the rotating fan main body 10 to pass through, so that the structure is simple, and the design is reasonable. The second plugging shaft 22 located in the middle cooperates with the clamping device 30, so that the center of gravity of the entire product is stable, and the stability of the product is improved.

The above description only describes embodiments of the present disclosure, and is not intended to limit the present disclosure, various modifications and changes can be made to the present disclosure. Any modifications, equivalent substitutions, improvements, etc. made within the spirit and scope of the present disclosure are intended to be included within the scope of the present disclosure.

What is claimed is:

1. A fan with an easy-to-assemble clamping device, comprising a fan main body, a supporting framework, and a clamping device; the fan main body is rotatably connected to the supporting framework; the supporting framework is rotatably connected to the clamping device; the clamping device comprises:

a first clamp body, wherein the first clamp body is rotatably connected to the supporting framework;

a second clamp body, wherein the second clamp body is rotatably connected to the first clamp body, and one side of the second clamp body facing to the first clamp body is provided with a limiting slot;

a torsional spring, wherein the torsional spring is plugged between the first clamp body and the second clamp body; a first free end of the torsional spring is abutted against a pressing end of the first clamp body; a second free end of the torsional spring is abutted against a pressing end of the second clamp body; and a main body of the torsional spring is abutted against a side wall of the limiting slot.

2. The fan according to claim 1, wherein the first clamp body is provided with a plugging part; the plugging part is provided with a rotating shaft; the second clamp body is provided with a plugging slot; a rotating shaft hole is arranged in the plugging slot; and the plugging part is plugged along the plugging slot, so that the rotating shaft is rotatably plugged to the rotating shaft hole.

3. The fan according to claim 2, wherein the rotating shaft is provided with a first guide slope; a side wall of the plugging slot is provided with a second guide slope; and when the plugging part is plugged along the plugging slot, the first guide slope slides along the second guide slope, so that the rotating shaft is rotatably plugged in the rotating shaft hole.

4. The fan according to claim 1, wherein a fitting arc surface is arranged inside the limiting slot; and an outer surface of a spiral part of the torsional spring is clung to the fitting arc surface.

5. The fan according to claim 1, wherein one side of a clamping end of the first clamp body facing to the second clamp body is provided with a first buffer pad; one side of a clamping end of the second clamp body facing to the first clamp body is provided with a second buffer pad; and the first buffer pad is abutted against the second buffer pad.

6. The fan according to claim 1, wherein one side of the second clamp body facing away from the first clamp body is provided with several friction pads.

7. The easy-to-assemble fan according to claim 1, wherein the supporting framework is U-shaped; the first plugging shaft is arranged at two free ends of the U-shaped supporting framework; and the second plugging shaft is arranged in the middle of the U-shaped supporting framework.

8. The fan according to claim 1, wherein one side of the first clamp body facing to the second clamp body is provided with a first accommodating slot; one side of the second clamp body facing to the first clamp body is provided with a second accommodating slot; the first free end of the torsional spring is clamped to the first accommodating slot; and the second free end of the torsional spring is clamped to the second accommodating slot.

9. The fan according to claim 8, wherein the fan main body is provided with a first plugging hole; one end of the supporting framework is provided with a first plugging shaft; a first limiting block is convexly arranged on a surface of a tail end of the first plugging shaft; the first plugging shaft is plugged to the first plugging hole; and the first limiting block is clamped to an edge of the first plugging hole.

10. The easy-to-assemble fan according to claim 9, wherein the first plugging shaft is provided with a first movable open slot extending along an axial direction of the first plugging shaft; and the first movable open slot is used for allowing the first plugging shaft to deform.

11. The easy-to-assemble fan according to claim 9, wherein a side wall of the first plugging hole is provided with a first guide slot; an edge of the first limiting block is provided with a first guide surface; and the first guide surface slides along the first guide slot when the first plugging shaft is plugged along the first plugging hole.

12. The easy-to-assemble fan according to claim 8, wherein the clamping device is provided with a second plugging hole; the other end of the supporting framework is provided with a second plugging shaft; a second limiting block is convexly arranged on a surface of a tail end of the second plugging shaft; the second plugging shaft is plugged to the second plugging hole; and the second limiting block is clamped to an edge of the second plugging hole.

13. The easy-to-assemble fan according to claim 12, wherein the second plugging shaft is provided with a second movable open slot extending along an axial direction of the second plugging shaft; and the second movable open slot is used for allowing the second plugging shaft to deform.

14. The easy-to-assemble fan according to claim 12, wherein a side wall of the second plugging hole is provided with a second guide slot; an edge of the second limiting block is provided with a second guide surface; and the second guide surface slides along the second guide slot when the second plugging shaft is plugged along the second plugging hole.

* * * * *